US009371703B2

(12) United States Patent
Roane et al.

(10) Patent No.: US 9,371,703 B2
(45) Date of Patent: Jun. 21, 2016

(54) TELESCOPING JOINT WITH CONTROL LINE MANAGEMENT ASSEMBLY

(71) Applicant: HALLIBURTON ENERGY SERVICES, INC., Houston, TX (US)

(72) Inventors: Thomas Owen Roane, Alvord, TX (US); William Mark Richards, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/375,465

(22) PCT Filed: Jul. 8, 2013

(86) PCT No.: PCT/US2013/049540
§ 371 (c)(1),
(2) Date: Jul. 30, 2014

(87) PCT Pub. No.: WO2015/005895
PCT Pub. Date: Jan. 15, 2015

(65) Prior Publication Data
US 2015/0330157 A1 Nov. 19, 2015

(51) Int. Cl.
*E21B 33/043* (2006.01)
*E21B 17/02* (2006.01)
*E21B 17/07* (2006.01)
*E21B 33/04* (2006.01)

(52) U.S. Cl.
CPC ..... *E21B 17/07* (2013.01); *E21B 17/026* (2013.01); *E21B 33/043* (2013.01); *E21B 33/0407* (2013.01)

(58) Field of Classification Search
CPC ..... E21B 17/07; E21B 17/026; E21B 33/043; E21B 33/0407
USPC ..... 166/355, 344, 345, 346, 347, 367
See application file for complete search history.

(56) References Cited

U.S. PATENT DOCUMENTS 3,718,183 A * 2/1973 Scott ..... E21B 17/07 166/346
4,626,135 A 12/1986 Roche
5,727,630 A 3/1998 Brammer
(Continued)

FOREIGN PATENT DOCUMENTS

WO 2010104667 9/2010
WO 2013019407 2/2013
(Continued)

OTHER PUBLICATIONS

International Patent Application No. PCT/US2013/049540, "International Seach Report and Written Opinion", mailed Mar. 31, 2014, 13 pages.

*Primary Examiner* — James G Sayre
(74) *Attorney, Agent, or Firm* — Kilpatrick Townsend & Stockton LLP

(57) ABSTRACT

A telescoping joint is provided with one or more control lines and is usable for landing a subsea tubing hanger. The telescoping joint can include an outer mandrel, an inner mandrel, and a control line. The inner mandrel can be releasably coupled to the outer mandrel when run in a wellbore of a subterranean formation. At least part of the inner mandrel can be in an area defined by the outer mandrel and can seal an inner area defined by the inner mandrel from an environment exterior to the outer mandrel. The control line can be exterior to an outer surface of the outer mandrel and coiled around at least part of the inner mandrel.

21 Claims, 5 Drawing Sheets

(56) References Cited

U.S. PATENT DOCUMENTS

| | | | | |
|---|---|---|---|---|
| 6,349,770 | B1 * | 2/2002 | Brooks | E21B 17/07 166/242.7 |
| 6,367,552 | B1 | 4/2002 | Scott et al. | |
| 6,540,025 | B2 | 4/2003 | Scott et al. | |
| 6,983,796 | B2 | 1/2006 | Bayne et al. | |
| 7,730,957 | B2 * | 6/2010 | Blanton | E21B 17/07 166/242.2 |
| 2004/0168794 | A1 * | 9/2004 | Vold | E21B 17/025 166/65.1 |
| 2005/0072564 | A1 | 4/2005 | Grigsby et al. | |
| 2010/0101778 | A1 * | 4/2010 | Lembcke | E21B 17/026 166/207 |
| 2011/0209651 | A1 | 9/2011 | Yemington | |
| 2013/0025880 | A1 | 1/2013 | Richards et al. | |
| 2014/0124217 | A1 * | 5/2014 | Godager | E21B 17/003 166/380 |
| 2015/0129240 | A1 * | 5/2015 | Bishop | E21B 43/12 166/381 |

FOREIGN PATENT DOCUMENTS

| | | |
|---|---|---|
| WO | 2014051565 | 4/2014 |
| WO | 2014051566 | 4/2014 |
| WO | 2014051568 | 4/2014 |
| WO | 2014130032 | 8/2014 |
| WO | 2014193419 | 12/2014 |
| WO | 2014193420 | 12/2014 |
| WO | 2015005897 | 1/2015 |

* cited by examiner

TELESCOPING JOINT WITH CONTROL LINE MANAGEMENT ASSEMBLY

CROSS-REFERENCE TO RELATED APPLICATIONS

This is a U.S. national phase under 35 U.S.C. 371 of International Patent Application No. PCT/US2013/049540, titled "Telescoping Joint With Control Line Management Assembly," filed Jul. 8, 2013, the entirety of which is incorporated herein by reference.

TECHNICAL FIELD

The present disclosure relates generally to a telescoping joint to be located in a wellbore and, more particularly (although not necessarily exclusively), to a telescoping joint with a control line management assembly for landing a subsea tubing hanger.

BACKGROUND

Drilling rigs supported by floating drill ships or floating platforms can be used for offshore wellbore creation and production. A telescoping joint (also referred to as a travel joint) in tubing can be used in running a tubing hanger in a wellhead for offshore production. After the tubing is set in a packer assembly downhole, the telescoping joint can be released to shorten from an extended position and allow the tubing hanger to be set in the wellhead.

Control lines can be coupled external to production tubing to provide a path for power, communication, and other purposes between surface instruments and flow control devices, gauges, and other components in the wellbore. Axial movements of the telescoping joint can impart stress on control lines. Axial movement, or stroking, distance of the telescoping joint may be limited in part because of the control lines.

Telescoping joints usable with control lines and that have scalable stroke distances are desirable.

DETAILED DESCRIPTION

Figure 1:
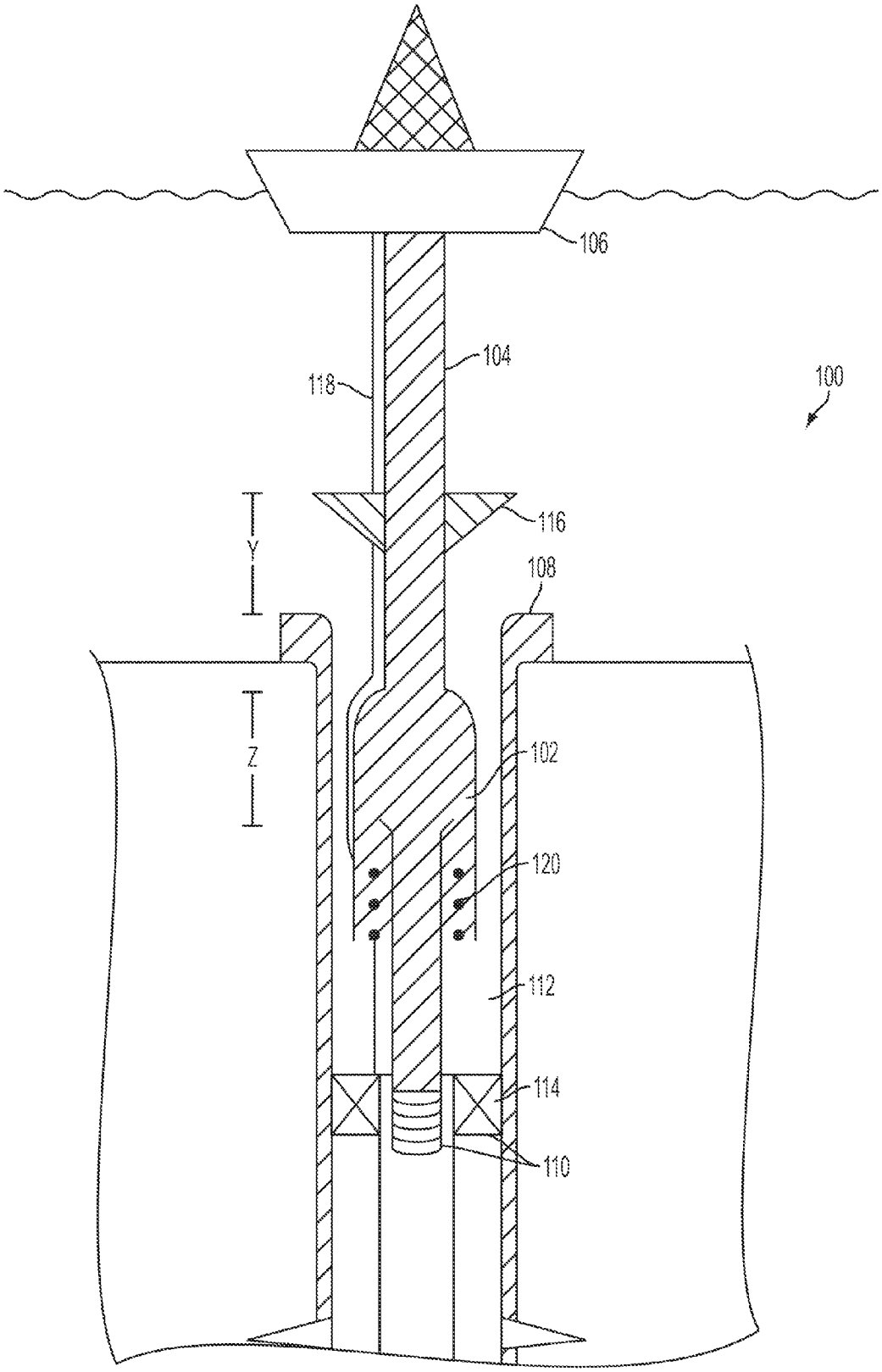
FIG. 1 is a cross-sectional view of a subsea well system with a telescoping joint according to one aspect.

Certain aspects and features relate to a telescoping joint with one or more control lines and that is usable for landing a subsea tubing hanger. The telescoping joint can be continuously sealing and can increase the amount of stroke (i.e., telescoping distance) achieved with multiple control lines running from one end of the telescoping joint to components positioned subsequent to the other end of the telescoping joint in the wellbore. In some aspects, the telescoping joint is a Long Space-Out Travel Joint.

A telescoping joint can include an inner mandrel and an outer mandrel. Seal stacks can isolate the tubing pressure in an inner diameter of the inner mandrel from annulus pressure on a seal bore on the outer mandrel. The inner mandrel can be anchored to the outer mandrel by a release assembly, which may be a metered release. Control lines can be wrapped as coils around the inner mandrel to allow for sufficient change in length. Control line guides or bushings can keep the coils aligned on the inner mandrel. A spline between the outer mandrel and the inner mandrel can prevent damage from coils rotating.

Control lines can be securely attached to the outside of the telescoping joint at an upper adapter, a hone bore, and release section. Control lines can transition to coils through a port in a shroud or other type of coil housing. Examples of control lines include a hydraulic control line, a fiber optic control line, an electrical control line, and a hybrid control line. Control lines can provide power, control, and/or data communication to completion components in the wellbore below the telescoping joint, or otherwise positioned in the wellbore such that the telescoping joint is between the components and a wellhead.

A telescoping joint according to some aspects can be picked up in three parts as a concentric pickup, assuming a sixty foot stroke, which may be possible using the telescoping joint. A bottom coil can be picked up first and set into a dual table on the rig floor. The release assembly and seals can be picked up second. An upper casing and adapters can be picked up third. The telescoping joint can be assembled in the run-in position.

In some aspects, the telescoping joint releases the outer mandrel from the inner mandrel for stroking using a tubing pressure release with the release assembly. If an upper seal is removed from the hone bore, then tubing pressure can be applied to the release assembly. In other aspects, the telescoping joint can be control line released using the release assembly. For example, a control line can be ported inside the release assembly to hydraulically release a set of dogs.

Telescoping joints according to various aspects can increase the stroke length, allow control lines to be run along the outside of the telescoping joints, and not expose control lines to produced fluid. For example, a telescoping joint may extend between ten feet and six hundred and fifty feet and the telescoping joint may be able to stroke to a range of zero and eighty feet. Using a telescoping joint according to certain aspects can allow a control line to be connected to a device operating at a formation of the well without limiting stroke distance of the telescoping joint.

These illustrative aspects and examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used as limitations of the scope herein.

FIG. 1 depicts a subsea well system 100 with a telescoping joint 102 according to one aspect. The subsea well system 100 includes a tubular string 104 that includes the telescoping joint 102. The tubular string 104 extends downwardly from a drilling rig 106. The drilling rig 106 may be a floating platform, drill ship, or jack up rig. In some aspects, the tubular string 104 may be inside a riser between the drilling rig 106 and a subsea wellhead 108.

The tubular string 104 can be stabbed into a completion assembly 110 that has been installed in a wellbore 112. The tubular string 104 can be sealingly received in a packer 114 at an upper end of the completion assembly 110. In some aspects, the tubular string 104 can have a seal stack that seals within a sealed bore receptacle. The tubular string 104 may also have flow control devices, valves, and other components, to control or regulate the flow of reservoir fluids into the tubular string 104. Control lines, such as control line 118 in FIG. 1, can provide power and communication to the components so that the components can be positioned from the surface, for example. The tubular string 104 can be connected with the completion assembly 110 using any suitable means.

The completion assembly 110 can be used in a completion process for at least a portion of the wellbore 112 that prepares the wellbore 112 for production or injection operations. The completion assembly 110 can include one or more elements that facilitate production or injection operations. Examples of elements that can be in the completion assembly 110 include packers, well screens, perforated liner or casing, production or injection valves, flow control devices, and chokes.

The telescoping joint 102 can be used, in effect, to shorten the tubular string 104 axially between the completion assembly 110 and the wellhead 108. After the tubular string 104 has been connected to the completion assembly 110, the telescoping joint 102 can be released to allow a tubing hanger 116 on the tubular string 104 to be landed in the wellhead 108. For example, the bottom portion of the tubular string 104 can be fixed and the top portion of the tubular string 104, including the telescoping joint 102 can stroke downward until the tubing hanger 116 lands on the wellhead 108.

The telescoping joint 102 can be released by any suitable release mechanism. In some aspect, the telescoping joint 102 includes a hydraulic release device that can release the telescoping joint 102 in response to a predetermined compressive force applied to the tubular string 104 for a predetermined amount of time. The telescoping joint 102 may also have a resetting feature that permits the telescoping joint 102 to be locked back after having been compressed. An example of a release mechanism is described in U.S. Pat. No. 6,367,552. Other examples of release mechanisms include shearing pins or screws, j-slots, ratchets, and control signals delivered by a control line.

A control line 118 extends from the drilling rig 106 external to the tubular string 104 to the telescoping joint 102. The control line 118 can be one or more control lines. At the telescoping joint 102, the control line 118 can be received through a port and coiled 120 around an inner mandrel of the telescoping joint 102. The control line 118 extends from the telescoping joint 102 to the completion assembly 110. The control line 118 can provide power, data communication, control, or a combination between a surface and elements of the completion assembly 110, components on the tubular string 104, or otherwise other components in the wellbore 112.

The telescoping joint 102 allows some variation in the length of the tubular string 104 between the tubing hanger 116 and the completion assembly 110 by, for example, allowing the length of the tubular string 104 to shorten after the completion assembly 110 has been sealingly engaged so that the tubing hanger 116 can be appropriately landed in the wellhead 108. The control line 118 can be coiled 120 to allow the telescoping joint 102 to stroke, such as by shortening the tubular string 104, without damaging the integrity of the control line 118. Certain aspects of the telescoping joint 102 allow for a longer stroke without damaging the control line 118 to account for variables such as a corkscrewing tubular, deviated wellbore, and drilling rig 106 changing position longitudinally and laterally due to currents and other forces. For example, the telescoping joint 102 should have a stroke distance, labeled Z in FIG. 1, that is greater than a potential distance, labeled Y in FIG. 1, between the tubing hanger 116 and the wellhead 108. Using a telescoping joint 102 according to certain aspects can allow the potential distance Y to be greater than distances that may have been previously realized, while also having the control line 118 extend from one end of the telescoping joint 102 to another end of the telescoping joint 102.

Figure 2:
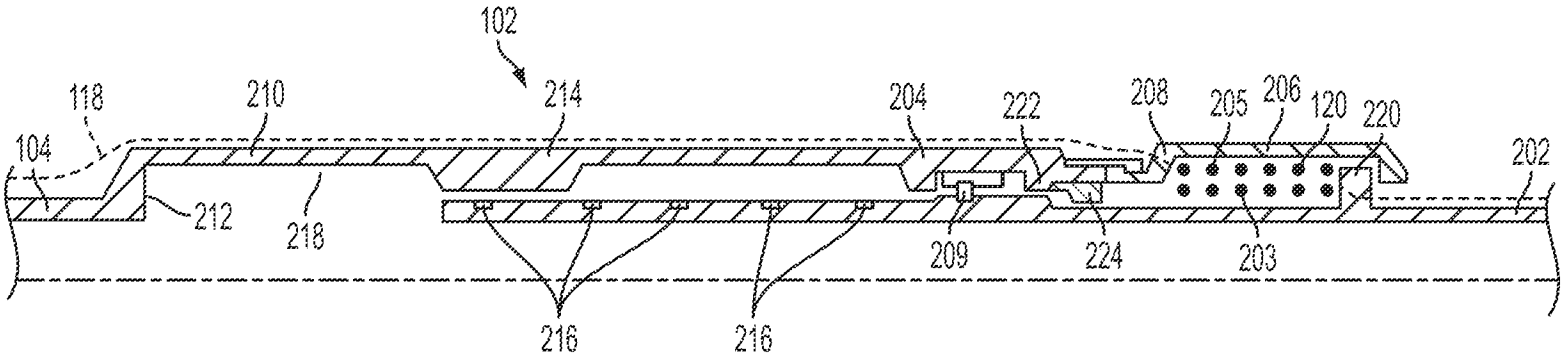
FIG. 2 is a cross-sectional view of part of a telescoping joint according to one aspect.

FIG. 2 depicts by cross-section part of the telescoping joint 102. The telescoping joint includes an inner mandrel 202, and outer mandrel 204, and a coil housing 206. In other aspects, the outer mandrel 204 includes the coil housing 206.

The coil housing 206 may be a shroud and includes a port 208 through which the control line 118 traverses from an area external to the outer mandrel 204 to be coiled 120 around the inner mandrel 202. The control line 118 in FIG. 2 includes two control lines 203, 205. Any number of control lines, including one, can be used. The telescoping joint 102 also includes a release mechanism 209 that can release the inner mandrel 202 from the outer mandrel 204 and allow the telescoping joint 102 to stroke.

Part of the outer mandrel 204 may be perforated. The outer mandrel 204 includes an upper housing 210 that is connected through an adaptor 212 to part of the tubular string 104. The upper housing 210 can be pressure containing, such as by providing a pressure seal between an inner diameter of the upper housing 210 and an outer diameter of the upper housing 210. The upper housing may be between one foot and one hundred feet long. In some aspects, the upper housing 210 is sixty feet long. The outer mandrel 204 also includes a hone bore 214.

On the inner mandrel 202 between the inner mandrel 202 and the outer mandrel 204 are seals 216 that can cooperate with the hone bore 214 to continuously seal an inner diameter of the inner mandrel 202 from annulus pressure around the outer mandrel 204. For example, when the tubular string 104 is landed, one of the seals 216 cooperates with the hone bore 214 for sealing. After the inner mandrel 202 is released from the outer mandrel 204, the outer mandrel 204 can move downward relative to the inner mandrel 202. As the outer mandrel 204 moves downward, the seal initially cooperating with the hone bore 214 for sealing moves into an outer mandrel groove 218 and another seal cooperates with the hone bore 214 for sealing. The seals 216 can be periodically spaced along an exterior surface of the inner mandrel 202 and cooperate with the hone bore 214 as the hone bore 214 axially moves relative to the inner mandrel 202.

The inner mandrel 202 also includes an inner bushing 220, which can define a transition point at which the control lines 203, 205 begin to coil. The coil housing 206 includes an outer bushing 222 that can define a point at which the control lines 203, 205 stop coiling.

The telescoping joint 102 also includes a spline 224 that is coupled to the outer mandrel 204. The spline 224 can be received by a groove (not shown in FIG. 2) in the inner mandrel 202 for preventing rotation of the inner mandrel 202 relative to the outer mandrel 204.

Figure 3:
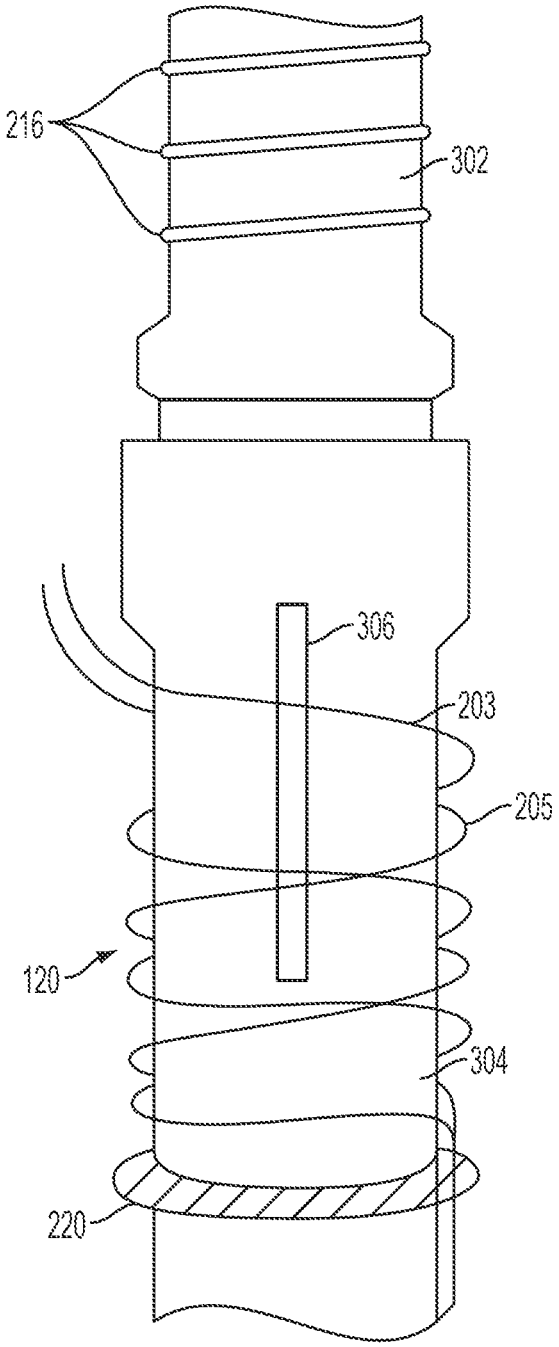
FIG. 3 is a perspective view of an inner mandrel of a telescoping joint according to one aspect.

FIG. 3 depicts by perspective view an example of the inner mandrel 202 according to one aspect. The inner mandrel 202 includes the seals 216 around an upper portion 302 of the inner mandrel 202. Control lines 203, 205 are coiled 120 around a lower portion 304 of the inner mandrel 202. The lower portion 304 of the inner mandrel 202 also includes a groove 306 on an outer surface of the lower portion 304. The groove 306 can receive the spline 224 in FIG. 2 to prevent rotation of the inner mandrel 202 relative to the outer mandrel 204.

In other aspects, the outer mandrel 204 includes the groove and the spline 224 is included in or coupled to the inner mandrel 202.

Figure 4:
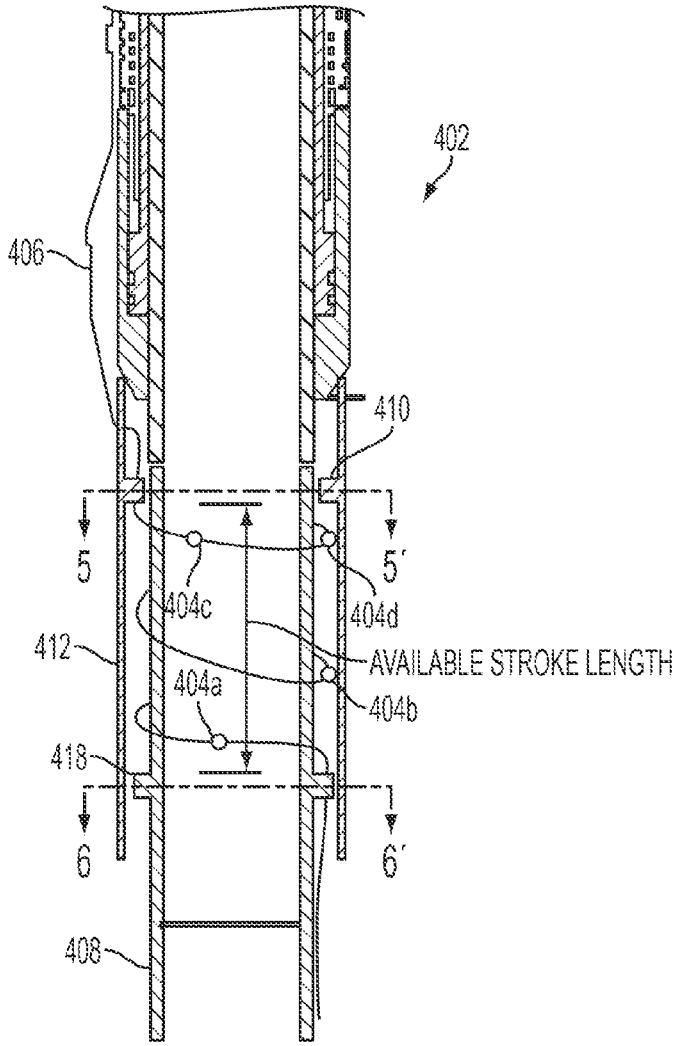
FIG. 4 is a cross-sectional view of a telescoping joint in an extended or a run position according to one aspect.

FIG. 4 depicts by cross-section a telescoping joint 402 in an extended or run position according to one aspect. The telescoping joint 402 can be prepared first and then shipped to an offshore rig for use in a wellbore. The telescoping joint 402 may include centralizing balls 404*a*, 404*b*, 404*c*, 404*d* on a control line 406 coiled around an inner mandrel 408. The centralizing balls 404*a*, 404*b*, 404*c*, 404*d* can prevent the control line 406 from overlapping another control line that may be present.

Figure 5:
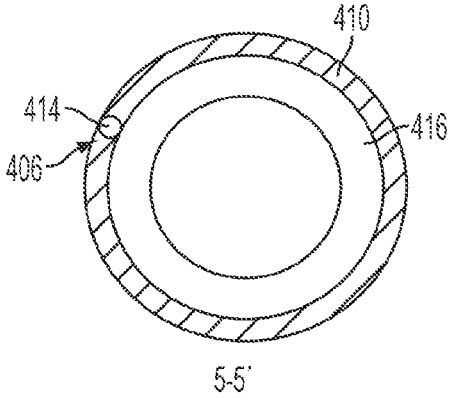
FIG. 5 is a cross-sectional view along line 5-5' in FIG. 4 according to one aspect.

The control line 406 can be connected through an outer bushing 410 coupled to a coil housing 412 to be coiled around the inner mandrel 408. FIG. 5 depicts a cross-sectional view along line 5-5' in FIG. 4 of the control line 406 through an opening 414 in the outer bushing 410 that is external to the inner mandrel 408 and an annulus space 416 between the outer bushing 410 and the inner mandrel 408.

Figure 6:
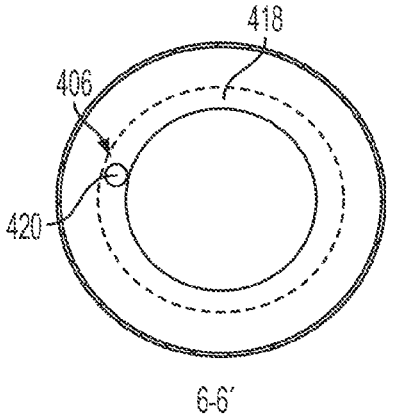
FIG. 6 is a cross-sectional view along line 6-6' in FIG. 4 according to one aspect.

Subsequent to the control line 406 coiling around the inner mandrel 408, the control line 406 can be connected through an inner bushing 418 of the inner mandrel 408 to part of tubular string located below the telescoping joint 402 (i.e., opposite the end of the telescoping joint closest to the surface). FIG. 6 depicts a cross-sectional view along line 6-6' in FIG. 4 of the control line 406 through an opening 420 in the inner bushing 418.

The distance between the outer bushing 410 and the inner bushing 418 can be the available stroke length that the telescoping joint 402 is able to stroke (i.e., shorten) without damaging or otherwise entangling the control line 406. In some aspects, the distance between the outer bushing 310 and the inner bushing 418 is in the range of forty feet to six hundred and forty feet, but distances less than and greater than this range are also possible.

Figure 7:
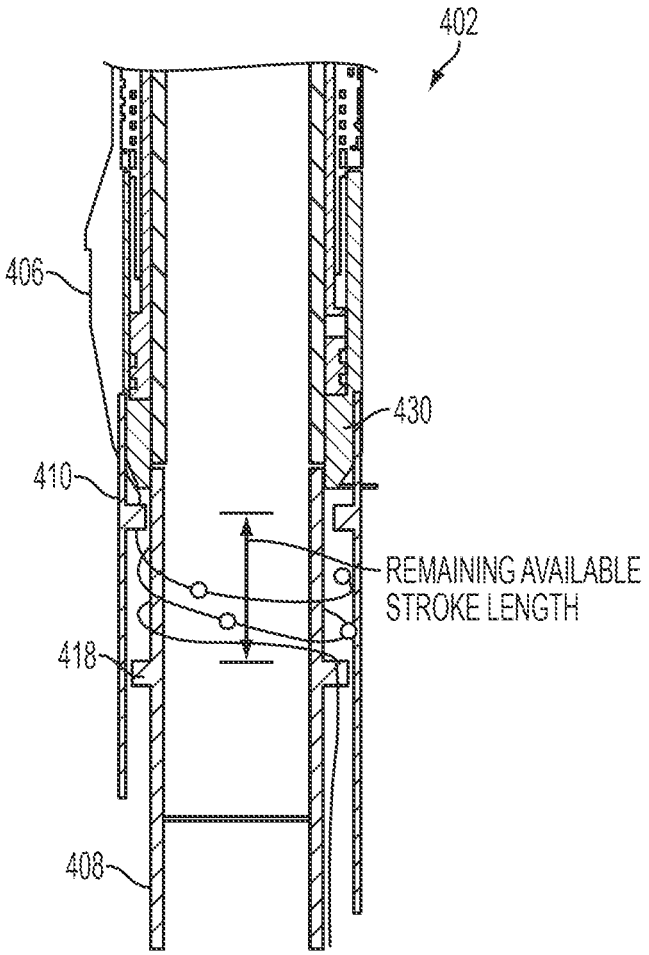
FIG. 7 is a cross-sectional view of a telescoping joint in a shortened or released position according to one aspect.

FIG. 7 depicts by cross-section the telescoping joint 402 in a shortened or released position according to one aspect. For example, a release mechanism can be controlled to release the outer mandrel 430 from being fixedly or coupled to the inner mandrel 408 and allow the outer mandrel 430 to stroke downward relative to the inner mandrel 408. The control line 406 coiled around the inner mandrel 408 may be forced by the outer bushing 410 and inner bushing 418 to become compressed in that the coils are forced to be closer together as compared to the telescoping joint 402 in the run position. The remaining available stroke length is less than the available stroke length when the telescoping joint 402 is in the run position. In some aspects, the outer mandrel 430 is adapted for stroking sixty feet relative to the inner mandrel.

Telescoping joints according to various aspects can have increased stroke length and control lines do not need to be exposed to produced fluids that may be in an inner diameter of an inner mandrel, for example. Telescoping joints according to some aspects can allow connectivity of a control line to a device operating at a wellbore formation while spacing out production tubing in a subsea completion.

The foregoing description of the aspects, including illustrated aspects, of the disclosure has been presented only for the purpose of illustration and description and is not intended to be exhaustive or to be limited to the precise forms disclosed. Numerous modifications, adaptations, and uses thereof will be apparent to those skilled in the art without departing from the scope.

What is claimed is:

1. A telescoping joint comprising:

an outer mandrel;

an inner mandrel releasably coupled to the outer mandrel, at least part of the inner mandrel being in an area defined by the outer mandrel and defining an inner area sealable from an environment exterior to the outer mandrel;

a control line exterior to an outer surface of the outer mandrel and coiled around the inner mandrel;

a coil housing having an opening therethrough for receiving the control line traversing from exterior to the outer surface of the outer mandrel to being coiled around the inner mandrel;

an outer bushing; and an inner bushing of the inner mandrel, wherein the control line is coiled between the outer bushings and the inner bushing.

2. The telescoping joint of claim 1, further comprising:

a first end of the telescoping joint that is part of the inner mandrel; and a second end of the telescoping joint positionable closer to a wellhead of the wellbore than the first end of the telescoping joint, wherein the control line extends from the second end to the first end.

3. The telescoping joint of claim 1, wherein the outer mandrel is releasable from the inner mandrel in the wellbore for stroking away from a wellhead and decreasing a length of a tubular string that includes the telescoping joint.

4. The telescoping joint of claim 3, wherein the inner mandrel includes seals for continuously sealing the inner area defined by the inner mandrel from the environment exterior to the outer mandrel when the outer mandrel strokes by isolating pressure between the inner area defined by the inner mandrel and the environment exterior to the outer mandrel.

5. The telescoping joint of claim 4, wherein the seals are periodically spaced along an exterior surface of the inner mandrel and in a cooperative relationship with a hone bore for continuously sealing the inner area defined by the inner mandrel from the environment exterior to the outer mandrel.

6. The telescoping joint of claim 5, wherein the seals include:

a first seal for cooperating with the hone bore to seal the inner area defined by the inner mandrel from the environment exterior to the outer mandrel prior to the outer mandrel being released from the inner mandrel; and at least a second seal for cooperating with the hone bore to seal the inner area defined by the inner mandrel from the environment exterior to the outer mandrel after the outer mandrel is released from the inner mandrel and when the outer mandrel strokes.

7. The telescoping joint of claim 1, wherein a distance between the outer bushing and the inner bushing is in a range of forty feet to six hundred and forty feet prior to the outer mandrel being released from the inner mandrel and prior to the outer mandrel stroking.

8. The telescoping joint of claim 1, wherein the outer mandrel is adapted for stroking sixty feet relative to the inner mandrel.

9. The telescoping joint of claim 1, further comprising:

a groove in an outer surface of the inner mandrel or an inner surface of the outer mandrel; and a spline receivable by the groove in preventing the outer mandrel from rotating with respect to the inner mandrel.

10. A tubular string, comprising:

at least part of an inner mandrel adapted for being in an area defined by an outer mandrel and for pressure sealing an inner area defined by the inner mandrel from a wellbore environment exterior to the outer mandrel;

the outer mandrel adapted for being released from the inner mandrel and for reducing a length of the tubular string by stroking toward a packer assembly;

a control line adapted for being exterior to a surface of the outer mandrel and coiled around the inner mandrel, wherein the inner mandrel includes seals for continuously sealing the inner area defined by the inner mandrel from the environment exterior to the outer mandrel when the outer mandrel strokes by isolating pressure between the inner area defined by the inner mandrel and the environment exterior to the outer mandrel; and a hone bore, wherein the seals are periodically spaced along an exterior surface of the inner mandrel and are adapted for cooperating with the hone bore for continuously sealing the inner area defined by the inner mandrel from the environment exterior to the outer mandrel.

11. The tubular string of claim 10, further comprising a telescoping joint that includes the inner mandrel, the outer mandrel, and the control line.

12. The tubular string of claim 10, wherein the seals include:

a first seal for cooperating with the hone bore to seal the inner area defined by the inner mandrel from the environment exterior to the outer mandrel prior to the outer mandrel being released from the inner mandrel; and at least a second seal for cooperating with the hone bore to seal the inner area defined by the inner mandrel from the environment exterior to the outer mandrel when the outer mandrel strokes and the hone bore moves axially relative to the inner mandrel.

13. The tubular string of claim 10, further including:

a coil housing having an opening therethrough for receiving the control line traversing from exterior to the outer surface of the outer mandrel to being coiled around the inner mandrel;

an outer bushing; and an inner bushing of the inner mandrel, wherein the control line is coiled between the outer bushing and the inner bushing.

14. The tubular string of claim 13, wherein a distance between the outer bushing and the inner bushing is in a range of forty feet to six hundred and forty feet prior to the outer mandrel being released from the inner mandrel and prior to the outer mandrel stroking.

15. The tubular string of claim 10, wherein the outer mandrel is adapted for stroking sixty feet relative to the inner mandrel.

16. The tubular string of claim 10, wherein the inner mandrel includes a groove in an outer surface of the inner mandrel, wherein the outer mandrel includes a spline receivable in the groove for preventing the outer mandrel from rotating with respect to the inner mandrel.

17. A telescoping joint for a tubular string, the telescoping joint including:

an inner mandrel;

an outer mandrel releasably coupled to the inner mandrel and moveable for stroking relative to the inner mandrel to shorten a length of the tubular string in effect, the inner mandrel defining an inner diameter that is pressure sealable from an environment that is exterior to the outer mandrel;

control lines exterior to the outer mandrel and coiled around the inner mandrel;

a groove in an outer surface of the inner mandrel or an inner surface of the outer mandrel; and a spline receivable by the groove in preventing the outer mandrel from rotating with respect to the inner mandrel.

18. The telescoping joint of claim 17, wherein the outer mandrel is adapted for stroking sixty feet relative to the inner mandrel.

19. The telescoping joint of claim 17, further including:

a coil housing having an opening therethrough for receiving the control line traversing from exterior to the outer surface of the outer mandrel to being coiled around the inner mandrel;

an outer bushing; and an inner bushing of the inner mandrel, wherein the control line is coiled between the outer bushing and the inner bushing.

20. The telescoping joint of claim 17, wherein the inner mandrel includes seals for continuously sealing the inner diameter defined by the inner mandrel from the environment exterior to the outer mandrel when the outer mandrel strokes by isolating pressure between the inner diameter defined by the inner mandrel and the environment exterior to the outer mandrel, wherein the seals are periodically spaced along an exterior surface of the inner mandrel and in a cooperative relationship with a hone bore for continuously sealing the inner diameter defined by the inner mandrel from the environment exterior to the outer mandrel.

21. The telescoping joint of claim 20, wherein the seals include:

a first seal for cooperating with the hone bore to seal the inner diameter defined by the inner mandrel from the environment exterior to the outer mandrel prior to the outer mandrel being released from the inner mandrel; and at least a second seal for cooperating with the hone bore to seal the inner diameter defined by the inner mandrel from the environment exterior to the outer mandrel after the outer mandrel is released from the inner mandrel and when the outer mandrel strokes.

* * * * *